US008146872B2

(12) United States Patent
Koning et al.

(10) Patent No.: US 8,146,872 B2
(45) Date of Patent: Apr. 3, 2012

(54) DISPLAY ATTACHMENT APPARATUS

(75) Inventors: David Koning, Hamilton, MI (US); Larry Koning, Holland, MI (US)

(73) Assignee: L S Mold, Inc., Holland, MI (US)

( * ) Notice: Subject to any disclaimer, the term of this patent is extended or adjusted under 35 U.S.C. 154(b) by 1028 days.

(21) Appl. No.: 12/082,383

(22) Filed: Apr. 10, 2008

(65) Prior Publication Data

US 2009/0255096 A1 Oct. 15, 2009

(51) Int. Cl.
*A47G 1/17* (2006.01)

(52) U.S. Cl. ..... 248/206.5; 248/317; 248/309.1; 40/621; 403/297; 24/303

(58) Field of Classification Search ..... 248/683, 248/317, 322, 309.1, 309.4, 305, 306, 321, 248/205.2, 206.5; 40/621, 671; 403/397, 403/353, 360, DIG. 1; 24/303, 306, 442
See application file for complete search history.

(56) References Cited

U.S. PATENT DOCUMENTS 2,094,107 A * 9/1937 Post ..... 24/564
2,448,611 A * 9/1948 Martin ..... 116/234
2,601,424 A * 6/1952 Baker ..... 24/66.1
2,784,757 A * 3/1957 Bosca et al. ..... 150/138
3,796,405 A * 3/1974 Rystad ..... 248/489
3,953,065 A * 4/1976 Shannon, Jr. ..... 294/1.1
4,255,837 A * 3/1981 Holtz ..... 24/303
4,258,493 A * 3/1981 Kettlestrings et al. ..... 40/600
4,588,209 A * 5/1986 Zebrowski et al. ..... 281/45
4,703,575 A * 11/1987 Diamond ..... 40/600
4,830,322 A * 5/1989 Gary ..... 248/206.5
4,899,974 A * 2/1990 Wear et al. ..... 248/467
4,953,714 A * 9/1990 Paul ..... 211/36
5,083,733 A * 1/1992 Marino et al. ..... 248/110
5,307,579 A * 5/1994 Clayton et al. ..... 40/600
5,425,160 A * 6/1995 Krapf ..... 24/67 R
5,557,902 A * 9/1996 Witmyer ..... 52/506.07
5,682,653 A * 11/1997 Berglof et al. ..... 24/303
2005/0283953 A1 * 12/2005 Jeffrey ..... 24/303
2006/0138293 A1 * 6/2006 Clement ..... 248/206.5
2006/0282993 A1 * 12/2006 Dietz ..... 24/303

* cited by examiner

*Primary Examiner* — Kimberly Wood
(74) *Attorney, Agent, or Firm* — The Watson I.P. Group, PLLC; Jovan N. Jovanovic; Vladan M. Vasiljevic

(57) ABSTRACT

A display attachment apparatus comprising a clamp assembly and a mounting assembly. The clamp assembly has a first clamp arm, a second clamp arm and a hinge assembly hingedly coupling the first clamp arm to the second clamp arm. Each clamp arm has a plurality of magnets which engage either corresponding magnets or other ferromagnetic members on an opposing clamp arm, when the clamp arm is in an engaging, or closed configuration.

12 Claims, 6 Drawing Sheets

DISPLAY ATTACHMENT APPARATUS

BACKGROUND OF THE DISCLOSURE

1. Field of the Disclosure

The disclosure relates in general to display apparatuses, and more particularly, to a display attachment apparatus which is configured to provide ease of mounting items to be displayed (such as posters, placards and display items). Additionally the display attachment apparatus greatly facilitates the removal and replacement of displayed items with minimal effort.

2.Background Art

The use of hanging displays is well known in the art. Typically posters and the like can be hung from ceilings and walls in a number of locations. For example, signs and posters are often hung overhead from the ceiling in stores (i.e., to display special offers and the like). Additionally, signs and posters are often hung from ceilings and walls in school classrooms.

Generally, these display items are attached to the ceiling by way of tape. In other structures, a fishing line is attached to the ceiling and to the display item. Often, to install the poster, the user must climb onto a chair or ladder. As these items are rarely found close at hand, a user often improvises with the use of less than optimal chairs, books, steps, etc. Often this leads to injury. Additionally, without such aids close at hand, the user often delays hanging display items, or resists changing the items that are displayed.

In other embodiments, specialized assemblies are utilized to attach a display to an outside structure. These specialized assemblies are often expensive and require special installation procedures. Thus, the use of these specialized assemblies is not widespread and is limited to particular installations.

It is an object of the present invention to provide a display attachment apparatus which facilitates the hanging of display items from outside structures.

It is another object of the present invention to provide a display attachment apparatus which can easily be installed in a number of different locations.

It is another object of the present invention to provide a display attachment apparatus which can be easily removed and reattached without the use of ladders, steps and the like.

These objects as well as other objects of the present invention will become apparent in light of the present specification, claims, and drawings.

SUMMARY OF THE DISCLOSURE

The disclosure is directed to a display attachment apparatus comprising a clamp assembly and a mounting assembly. The clamp assembly has a first clamp arm, a second clamp arm and a hinge assembly hingedly coupling the first clamp arm to the second clamp arm. Each clamp arm has a plurality of magnets which engage either corresponding magnets or other ferromagnetic members on an opposing clamp arm, when the clamp arm is in an engaging, or closed configuration.

The mounting assembly has an outside surface attachment subassembly, a clamp attachment subassembly and a coupling structure. The clamp attachment subassembly includes either a magnet or a ferromagnetic member releasably engageable with at least one of the corresponding magnets and ferromagnetic members of one of the first and second clamp arms. The coupling structure couples the outside surface attachment subassembly to the clamp attachment assembly in operable engagement.

In a preferred embodiment, a mating engagement member is positioned proximate each of the plurality of magnets and corresponding magnets and ferromagnetic members and a corresponding mating engagement member is disposed on the clamp attachment assembly proximate the one of the magnet and the ferromagnetic member of the clamp attachment subassembly. Upon engagement of the clamp attachment assembly and the clamp assembly, the mating engagement member of the clamp assembly and the mating engagement member of the clamp attachment assembly positively engage. As a result, any slidable movement is limited which prevents disengagement of the clamp assembly and the clamp attachment subassembly.

In a preferred embodiment, the mating engagement member of one of the clamp assembly and the clamp attachment subassembly comprises a post and the mating engagement member of the other of the clamp assembly and the clamp attachment subassembly comprises a slot.

In one such embodiment, the slot comprises an arcuate slot centered about the corresponding magnet or ferromagnetic member which allows for at least partial rotation of the clamp attachment subassembly about the corresponding magnet or ferromagnetic member.

In another embodiment, the outside surface attachment subassembly further comprises one of a magnet and a c-channel clamp.

In another preferred embodiment, the coupling structure comprises a cavity having an opening and an access slot positioned on the clamp attachment subassembly or the outside surface attachment subassembly. A tab extends from a neck on the other of the clamp attachment subassembly and the outside surface attachment assembly. The tab can be inserted in the cavity through the access slot so that the neck extends through the opening, while the tab is larger than the opening, and precluded from passage therethrough. Additionally, the tab can rotate while positioned within the cavity.

In another preferred embodiment, the first clamp arm includes three spaced apart magnets that engage three corresponding magnets on the second clamp arm. Each of the magnets is positioned within a magnet housing that extends inwardly on each clamp arm. Each clamp arm has an inward projection terminating at the hinge, such that upon engagement of the magnets of the first and second clamp arms with a display member positioned therein, the clamp arms are substantially parallel to each other and have a substantially uniform distance therebetween.

In another preferred embodiment, each of the first clamp arm and the second clamp arm further include an outward flange that extends orthogonal from a bottom end of each clamp arm.

In a preferred embodiment, the hinge assembly comprises a plurality of discrete live hinge members joining the first clamp arm and the second clamp arm.

In another preferred embodiment, the apparatus further comprises an installation tool, comprising a body and an upper end engagement member. The body has a central coupling region and opposing clamp arm engagement structures. The clamp engagement structures each have a pair of fingers which are configured to engage a portion of a bottom end of the first clamp arm or the second clamp arm therebetween. The upper end engagement member is configured to extend over and beyond the top end of the first and second clamp arms so as to positively engage and maintain the bottom end of the first clamp arm or the second clamp arm to which it is attached.

In a preferred embodiment, the installation tool has a pole extending from the central coupling region.

In a preferred embodiment, the plurality of magnets and ferromagnetic members are integrally molded with at least one of the clamp arms.

In another preferred embodiment, the clamp attachment subassembly further comprises a first side and a second side. A magnet extends from the first side to the second side. A mating engagement member extends outwardly from each of the first and second sides proximate the magnet.

BRIEF DESCRIPTION OF THE DRAWINGS

The disclosure will now be described with reference to the drawings wherein.

DETAILED DESCRIPTION OF THE DISCLOSURE

Figure 1:
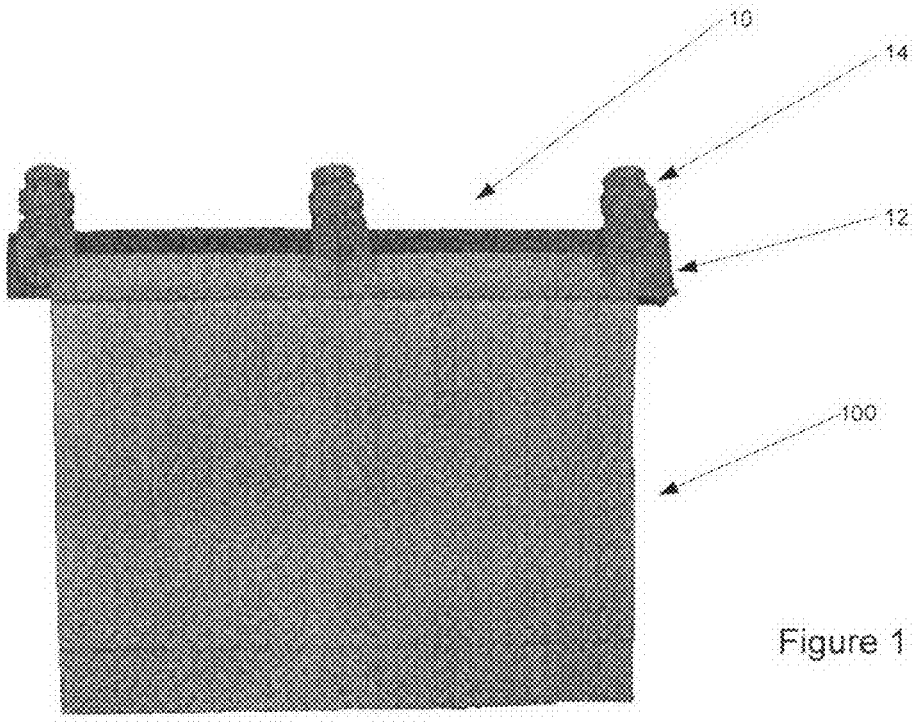
FIG. 1 of the drawings comprises a front plan view of the display attachment apparatus of the present invention, showing, in particular, the apparatus in use.
Figure 2:
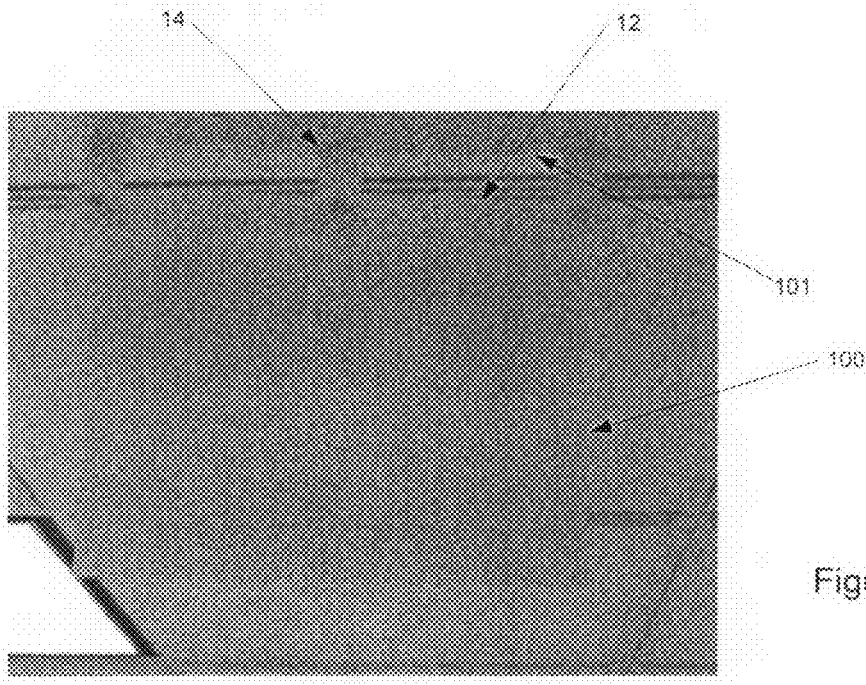
FIG. 2 of the drawings comprises a front plan view of the display attachment apparatus of the present invention, showing, in particular, the apparatus in use and attached to an outside structure.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the display attachment apparatus 10 includes clamp assembly 12 and, typically, a plurality of mounting assemblies, such as, mounting assembly 14. Additionally, an installation tool 18 (FIGS. 17 and 18) is provided to remotely reach the apparatus. Generally, and as will be explained in substantially greater detail below, a display card, poster or other member 100 that is to be displayed is positioned within the clamp assembly and releasably maintained therein. The mounting assembly 14 is coupled to a wall, a ceiling (i.e., by coupling to the framing 101 of a drop down ceiling, for example), a door frame, amongst others. The clamp assembly is then attached to the mounting assembly and the resulting apparatus displays the display card 100. Conveniently, not only is the display member easily replaceable, but the mounting assembly is easily removed from engagement with the outside surface. Moreover, the mounting assembly can be easily detached from the clamp assembly with the aid of the tool, to assist with replacement of the display item 100 while not requiring removal of the mounting assembly, and allowing for such work to be accomplished remotely.

Figure 3:
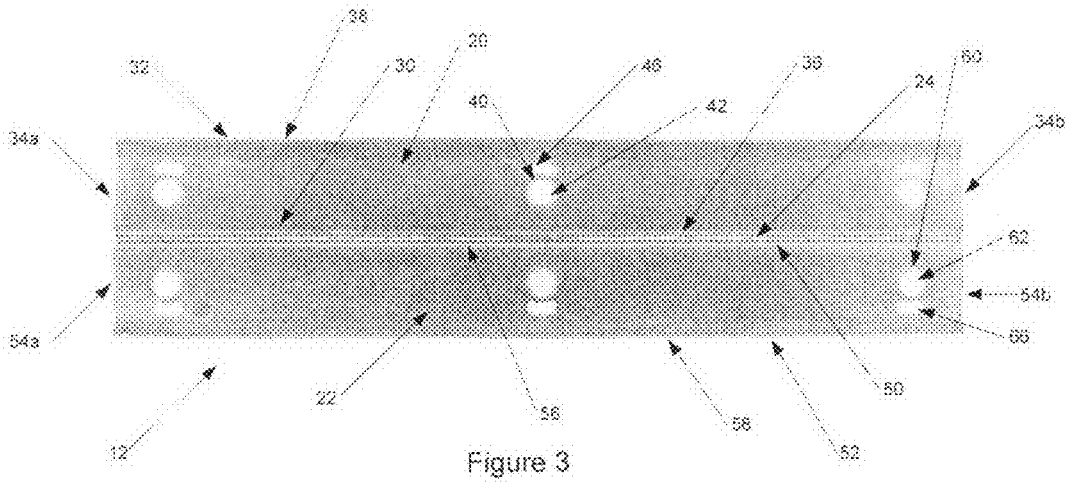
FIG. 3 of the drawings comprises a back plan view of the clamp assembly of the present invention, wherein the hinge is in the open orientation.
Figure 4:
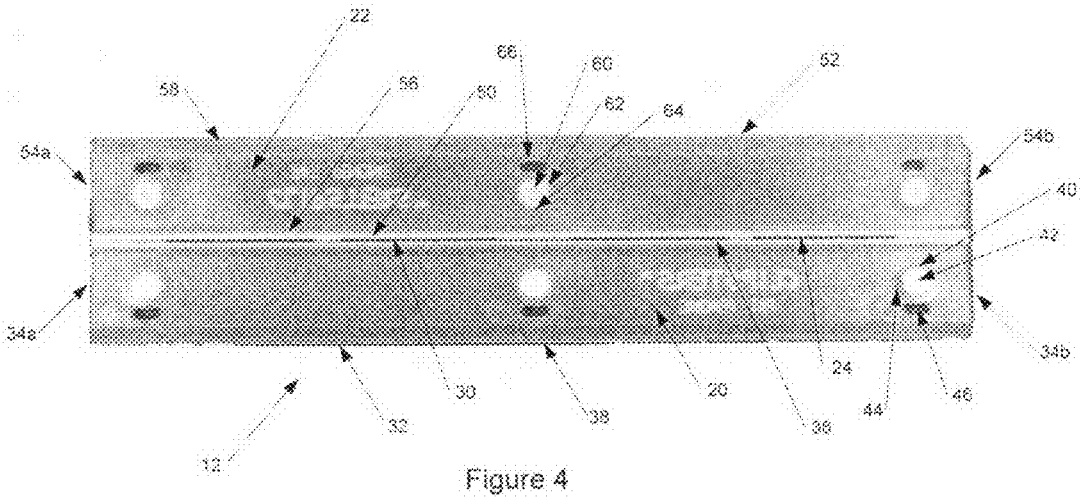
FIG. 4 of the drawings comprises a front plan view of the clamp assembly of the present invention, wherein the hinge is in the open orientation.

The clamp assembly 12 is shown in detail in FIGS. 3 and 4 as comprising first clamp arm 20, second clamp arm 22 and hinge assembly 24. The first clamp arm 20 includes top end 30, bottom end 32 side edges 34*a*, 34*b*, an inward projection 36 proximate top end 30 and an outward flange 38 positioned proximate bottom end 32. The first clamp arm is approximately 11.5" in length (i.e., slightly longer than the length of an 8.5"×11" sheet of paper). The width of the first clamp arm is approximately 1.5". It will be understood that the dimensions can be varied without departing from the scope of the present invention.

Figure 6:
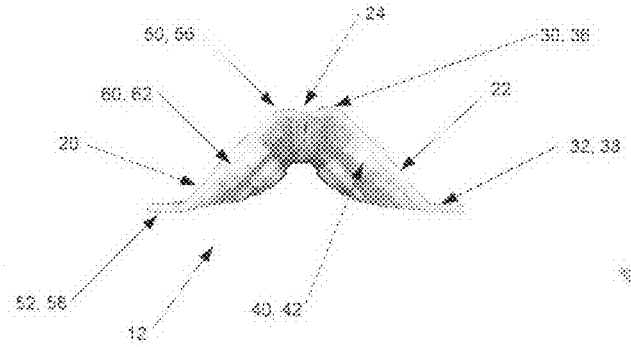
FIG. 6 of the drawings comprises a perspective view of the clamp assembly of the present invention, showing a partially open orientation.
Figure 7:
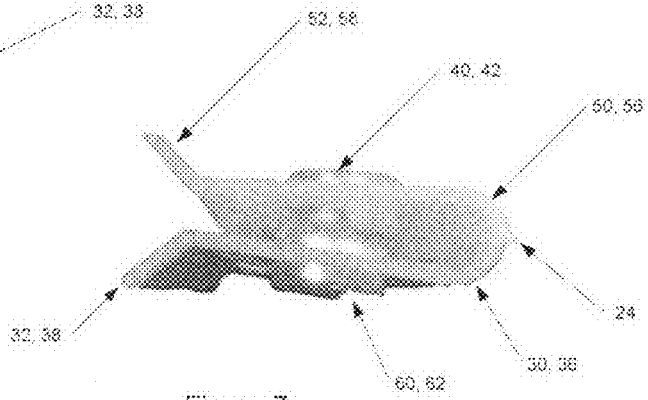
FIG. 7 of the drawings comprises a side plan view of the clamp assembly of the present invention, showing a closed orientation.
Figure 8:
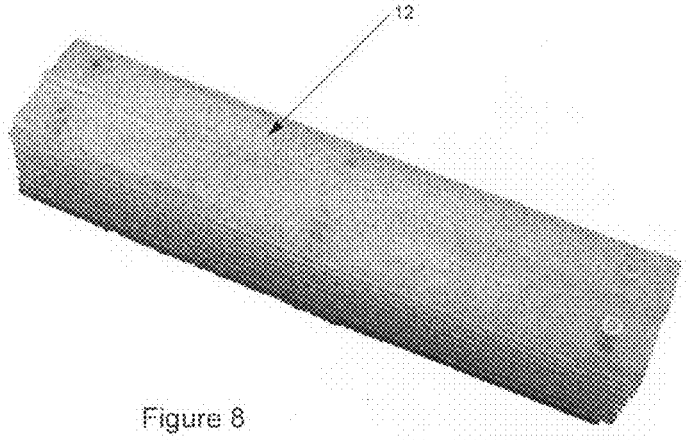
FIG. 8 of the drawings comprises a perspective view of a plurality of clamp assemblies all nested on top of each other.

With reference to FIGS. 6 and 7, the outward flange 38 is positioned at the bottom end 32 of the first clamp arm. The outward flange extends along the entire length of the first clamp arm. In other embodiments, the outward flange may extend only partially between the side edges 34*a*, 34*b* and may comprise multiple segments. The outward flange provides an enhanced rigidity to the first clamp arm. Additionally, the outward clamp interfaces with the installation tool to facilitate coupling thereof to the clamp assembly.

Figure 5:
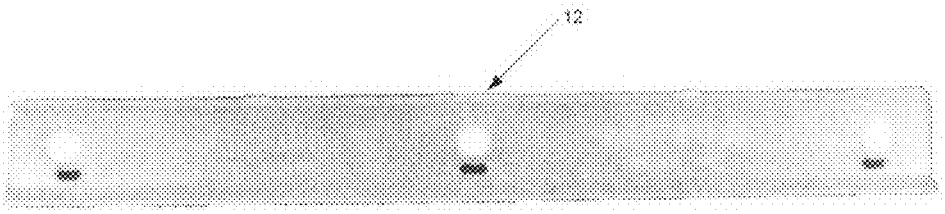
FIG. 5 of the drawings comprises a side elevational view of the clamp assembly of the present invention, wherein the hinge is in the closed orientation.

As can be seen in FIGS. 3 through 5, the three magnets are spaced apart along the first clamp arm. The three magnets 42 are encased by magnetic housings, such as magnetic housing 40. The housing encases the magnet, but includes a couple of perforations 44. With reference to FIGS. 6 and 7, as the magnets are thicker than the thickness of the first clamp arm, they extend above both the inner and outer surfaces of the first clamp arm.

With reference to FIGS. 3 and 4, below each of the magnets 42, an engagement member 46 is positioned. The engagement member 46 comprises an arcuate slot which has its center at or near the magnet 40, so as to extend about the magnet an arcuate distance. The slot extends entirely through the first clamp arm and defines an opening. In other embodiments, the slot may only be indented in the surface of the first clamp arm, wherein it would not extend through the entirety of the first clamp arm.

The second clamp arm 22 is essentially a substantially identical mirror image of the first clamp arm. The second clamp arm includes top end 50, bottom end 52, side edges 54*a*, 54*b*, inward projection 56 and outward flange 58. In addition, a plurality of magnets 62 are spaced so as to correspond to the magnets of the first clamp arm. The magnets are each positioned within the magnetic housing which includes perforations 64. Engagement members, such as engagement member 66 is positioned proximate each of the plurality of magnets.

The first and second clamp arms are configured such that the magnets match up with each other. It will be understood that while magnets are positioned in each of the magnet housings of the first and second clamp arm, certain of the magnets can be replaced with ferromagnetic material instead. For example, three magnets can be positioned within the first clamp, and three ferromagnetic materials may be positioned within the second clamp. Other configurations are likewise contemplated, as long as the mating pairs have at least one magnet. It will also be understood that the proper orientation of the north and south poles of the magnets should be considered to achieve the proper mating engagement.

The magnets in the embodiments shown comprise circular magnets that are akin to short cylindrical members. In other embodiments, the magnets may comprise rectangular, circular, square, polygonal, as well as arbitrary configurations. The magnets, it is contemplated, comprise high strength magnets which are configured to grasp with a substantial force. It will be understood that a number of different magnets are contemplated for use. The stronger the magnets, the better the hold, and the heavier the materials that can be held and retained. The invention is not limited to any particular magnets, or to magnets of any particular composition, size or shape. Additionally, while three magnets (or ferromagnetic materials) are contemplated as being positioned along the first clamp arm, a greater or lesser number are likewise contemplated for use.

With reference to FIGS. 6 and 7, the first and second clamp arms 20, 22, respectively, are joined together with the aid of a hinge assembly 24. The hinge assembly comprises a plurality of discrete living hinge members. The plurality of hinge members couples the two clamp arms together proximate the top end thereof. It will also be understood that the hinge assembly, the first clamp arm and the second clamp arm are integrally molded as a single integrated member. It will be understood that the first clamp arm, the second clamp arm and the hinge assembly may comprise separate members that are merely coupled together through mechanical fasteners, adhesives or melted together after molding. In other embodiments, the hinge assembly may comprise hinge elements that rotate about a post, or the like.

Figure 9:
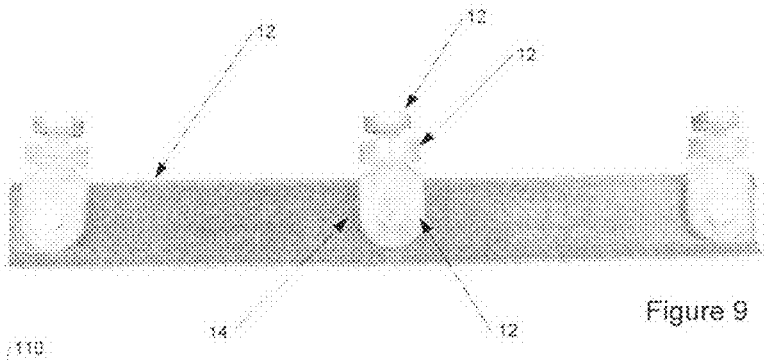
FIG. 9 of the drawings comprises a side elevational view of the display attachment apparatus showing three mounting assemblies attached to the clamp assembly.
Figure 14:
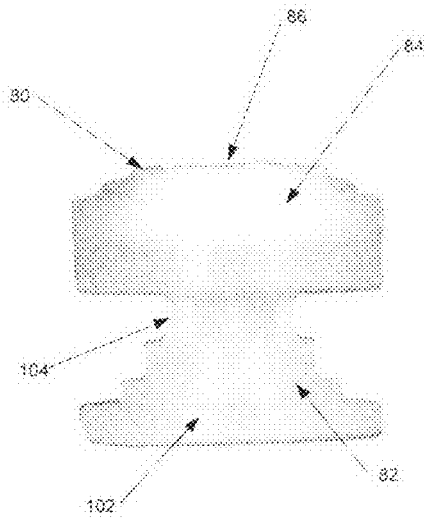
FIG. 14 of the drawings comprises a side elevational view of the outside surface attachment subassembly of the present invention.
Figure 16:
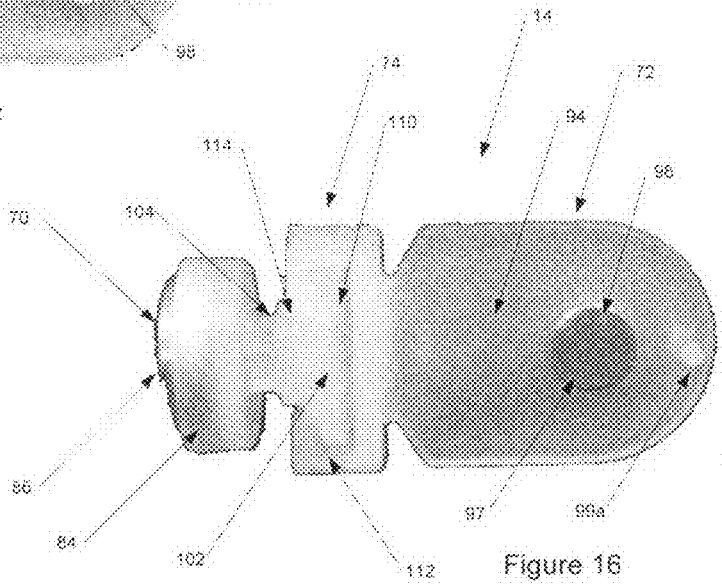
FIG. 16 of the drawings comprises a side elevational view of another embodiment of the mounting assembly of the present invention.

The mounting assembly 14 is shown in FIG. 16 as comprising outside surface attachment subassembly 70, clamp attachment subassembly 72 and coupling structure 74. A clamp assembly having three mounting assemblies 14 is shown in FIG. 9. The outside surface attachment subassembly is coupled to an outside structure, such as a wall, ceiling, door frame and the like. With additional reference to FIG. 14, the outside surface attachment subassembly includes proximal end 80, distal end 82, magnet retention member 84 and magnet 86. The magnet retention member comprises a cavity with an upward opening, and the magnet is press fit therein, so that it faces in an upward direction, at the distal end thereof.

Figure 13:
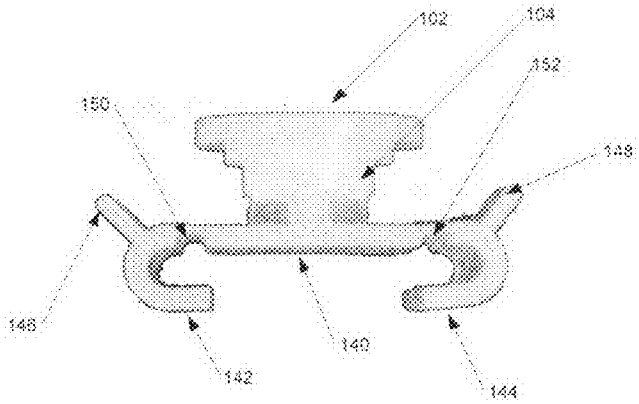
FIG. 13 of the drawings comprises a side elevational view of the outside surface attachment subassembly of the present invention.
Figure 15:
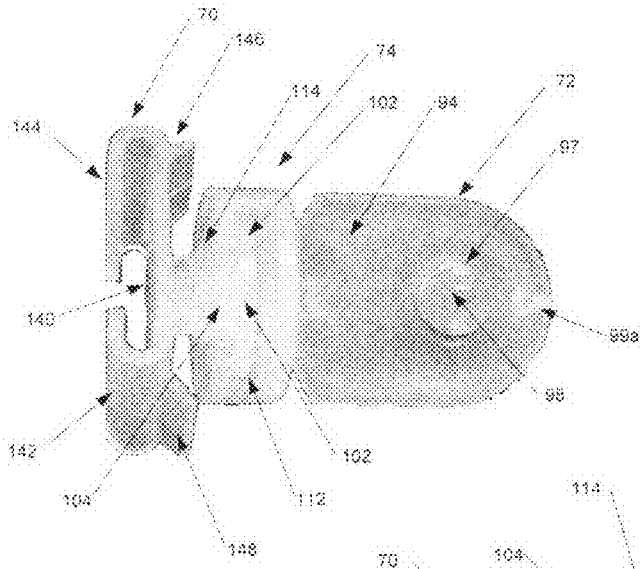
FIG. 15 of the drawings comprises a side elevational view of the mounting assembly of the present invention.

In another embodiment, as is shown in FIGS. 13 and 15, the outside surface attachment assembly 70 comprises a c-clamp having central region 140 and c-clamp regions 142 and 144 on opposing sides of the central region. The c-clamps are coupled to the central region by way of a thinner region 150, 152, respectively, and include grasping flanges 146, 148. It will be understood that when the grasping flanges are flexed toward each other, the c-clamps bend about the thinner region and effectively expand the space between the two c-clamps. In turn, the c-clamps can be extended around the side edges of a metal frame (i.e., a metal frame utilized for drop ceilings). Once released, the c-clamps return to their original configuration thereby grasping and retaining the metal frame of the drop ceiling.

Figure 10:
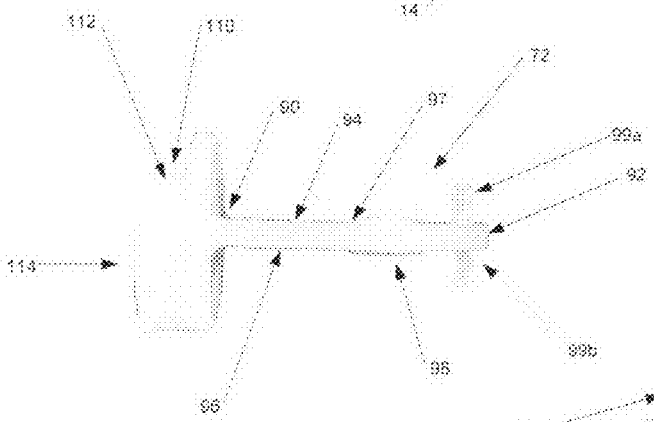
FIG. 10 of the drawings comprises a side elevational view of the clamp attachment subassembly of the present invention.
Figure 11:
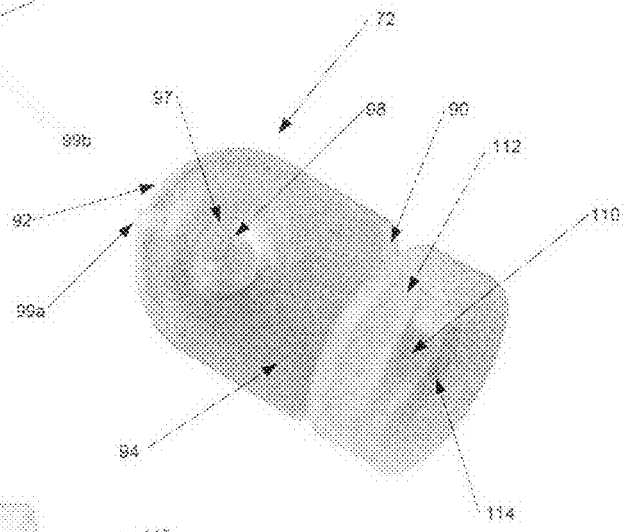
FIG. 11 of the drawings comprises a perspective view of the clamp attachment subassembly of the present invention.
Figure 12:
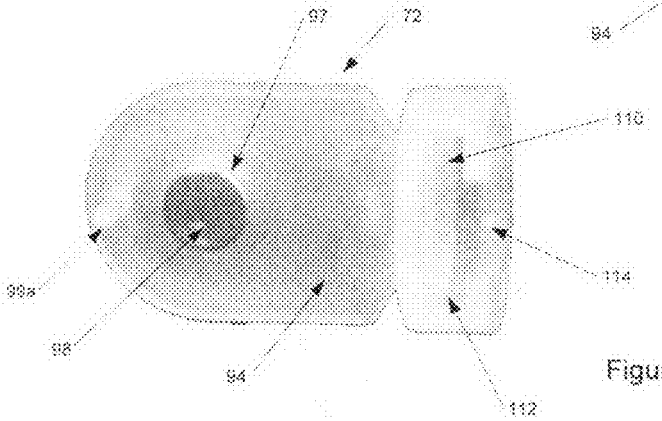
FIG. 12 of the drawings comprises a side elevational view of the clamp attachment subassembly of the present invention.

With reference to FIGS. 10 through 12, the clamp attachment subassembly 72 includes proximal end 90, distal end 92, first side 94, second side 96, magnet retainer 97, magnet 98 and mating engagement members 99*a*, 99*b*. The first and second sides 94, 96, respectively, are substantially parallel and evenly spaced apart from each other. The magnet retainer 97 comprises an opening that extends through the first and second sides 94, 96 and the magnet 98 is press-fit therein (or integrally molded thereto). Near the magnet on each of the first and second sides 94, 96, a mating engagement member 99*a*, 99*b* is positioned. The mating engagement member 99*a*, 99*b* comprises a post member that is configured to be received and retained within the slot of the engagement member 46, 66 of the first and second clamp arms 20, 22. Inasmuch as the slot is substantially larger than the post, the post can travel along the slot, as the clamp attachment assembly is rotated or pivoted relative to the respective clamp arm 20, 22.

It will be understood that in other embodiments, the post may be positioned on the clamp arm whereas the slot may be positioned on the clamp attachment subassembly. In other embodiments, other structures which matingly engage with each other can be utilized. The purpose of the engagement members is to limit the slidable movement of the magnets of the clamp arms that are engaged to the clamp attachment subassembly. While magnets have great strength in tension, magnets can slide relative to each other with substantially less than the force required to separate. In turn, gravity can pull the magnets so that they slide relative to each other. The engagement members stop the slidable movement of the magnets relative to each other. It will be understood that only some of the magnets of the clamp arms and the clamp attachment subassemblies may include engagement members.

With reference to FIGS. 15 and 16, the coupling structure 74 comprises a tab assembly 102 and neck assembly 104. The neck assembly 104 extends outwardly at the proximal end 80 of the outside surface attachment assembly. The neck assembly 104 terminates at tab assembly 102. The tab assembly 102 comprises a substantially planar element that is perpendicular to the axis of the neck assembly 104. The tab assembly and the neck assembly are integrally molded with the remainder of the outside surface attachment subassembly.

The coupling structure 74 further includes cavity 110, access slot 112 and receiving opening 114. This portion of the coupling structure is attached to (or integrally molded) with the clamp attachment subassembly. The cavity 110 has an access slot 112 in a sidewall thereof and a receiving opening 114. The receiving opening 114 is circular, but it is larger than the tab assembly, whereas the cavity is circular and sized to accommodate the tab assembly. The tab assembly can be pushed into the cavity 110 through the receiving opening 114. The receiving opening is sized so that the tab assembly elastically deforms upon insertion. As such, the tab assembly is retained and inadvertent dislodging is minimized.

Additionally, as the tab assembly is circular and as the cavity is appropriately sized, the tab assembly can rotate within the cavity through a full rotation. In other embodiments, stops can be provided so that only partial rotation is allowed. Furthermore, it is contemplated that the tab assembly can be provided on the clamp attachment assembly and the cavity can be provided on the outside surface attachment subassembly. In other embodiments, a different structure can be utilized, such as a ball and socket joint, or the like. In such an embodiment, a ball can be positioned on one of the outside surface attachment subassembly and the clamp attachment subassembly, and a socket can be positioned on the other one of these structures. In another embodiment, the coupling structure can include a magnet or ferromagnetic member, one of which is coupled to the outside surface attachment subassembly and the other of which is coupled to the clamp attachment subassembly. In another embodiment, the coupling structure can be integrated with each of the outside surface attachment subassembly and the clamp attachment subassembly.

Figure 17:
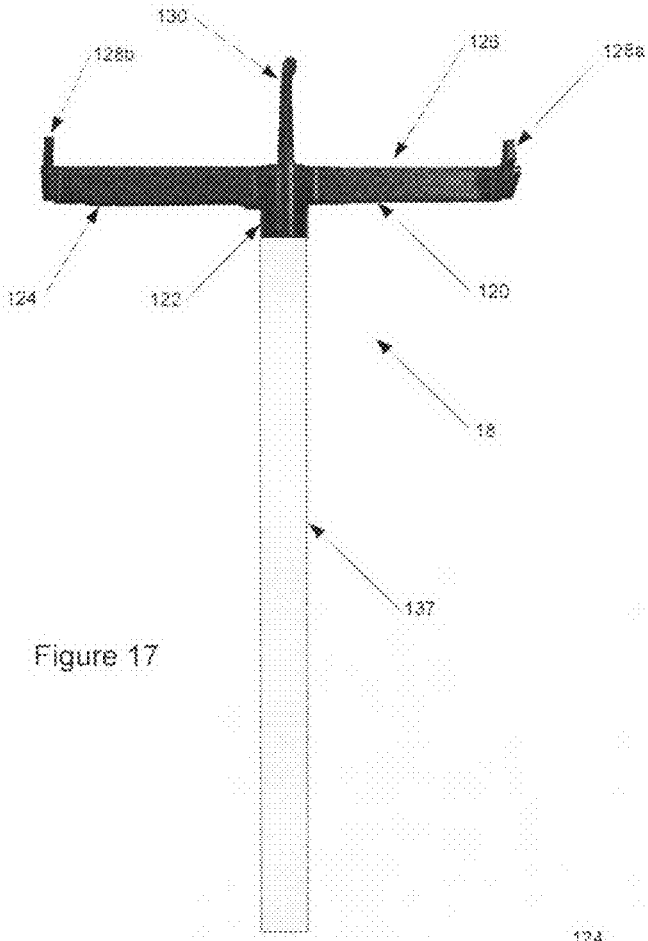
FIG. 17 of the drawings comprises a front plan view of the installation tool of the present invention.
Figure 18:
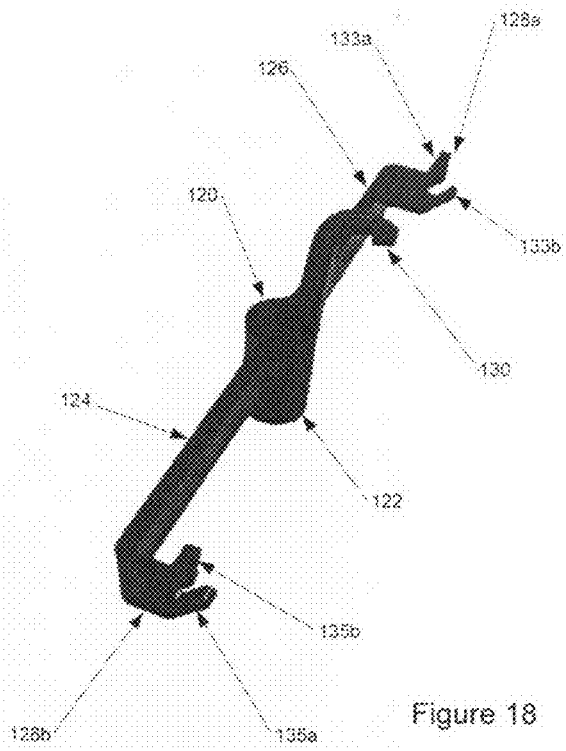
FIG. 18 of the drawings comprises a perspective view of the installation tool of the present invention.

The installation tool 18 is shown in FIGS. 17 and 18 as comprising body 120 having central coupling region 122, wings 124, 126, opposing clamp arm engagement structures 128*a*, 128*b* and upper end engagement member 130. Each opposing clamp arm engagement structures 128*a*, 128*b* include a pair of angled fingers 133*a*, 133*b*, respectively and 135*a*, 135*b* spaced apart from each other. The angled fingers of each of the opposing clamp arm engagement structures are configured to engage the outward flange of either one of the first clamp arm and the second clamp arm. As the clamp arm engagement structures engage the respective clamp arm, the upper end engagement member extends over the top end of the clamp arms so as to substantially engage the desired clamp arm.

A pole 137 can be inserted into the central coupling region 122 so that the reach of the installation tool can be extended. In certain embodiments, the pole can be integrally molded with the central coupling region. In others, it may be a completely separate member.

In operation, a desired placard, poster, display or other structure that is to be coupled to the display attachment apparatus is first selected. Secondly, the outside structure to which the apparatus is to be coupled is determined. In the embodiment shown, the outside structure comprises a steel frame typically utilized with a suspended drop ceiling.

The clamp assembly is first positioned in the open position so that it is ready to accept the display member. The display member is positioned in a desired orientation relative to one of the clamp arms, and the other clamp arm is rotated about the hinge assembly until the respective magnets of each of the first and second clamp arms are attracted toward each other and engage. Due to the size of the inward projections, and the extent to which the magnets extend from the inner surface of the clamp arm, once a thicker display item (i.e., $1/16^{th}$ of an inch) is positioned within the clamp arms, the clamp arms are essentially parallel to each other. With thicker display items, or thinner display items, the clamp arms may be oblique to each other.

Once the display item has been positioned, the clamp assembly is ready for mounting. In turn, the mounting assembly is then coupled to the desired outside structure. In particular, the desired type of outside surface attachment subassembly is selected. The mounting assembly is then connected to the outside structure. Once connected, the clamp assembly can be connected with the mounting assembly.

If the apparatus is positioned in a remote location, the installation tool can be utilized to retrieve the apparatus. In particular, the tool can be manipulated so that the angled fingers grasp spaced apart regions of the outward flange of one of the clamp arms. Subsequently, the installation tool is rotated so that the upper end engagement member extends beyond the hinge of the clamp assembly. At that time, the installation tool can be rotated to disconnect the clamp assembly from the mounting assemblies. The clamp assembly (or the display item) can then be retrieved as desired. The installation tool can also be used to grasp the clamp assembly for installation in a remote location.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A display attachment apparatus comprising:

a clamp assembly having a first clamp arm, a second clamp arm and a hinge assembly hingedly coupling the first clamp arm to the second clamp arm, the first clamp arm having a plurality of magnets and the second clamp arm having a plurality of at least one of magnets and ferromagnetic members, the plurality of magnets on the first clamp corresponding to the plurality of at least one of magnets and ferromagnetic members so as to be attracted to each other when the clamp assembly is in an engaging configuration; and a mounting assembly having an outside surface attachment subassembly structurally configured to engage an outside surface;

a clamp attachment subassembly which includes one of a magnet and a ferromagnetic member releasably engageable with at least one of the corresponding magnets and ferromagnetic members of one of the first and second clamp arms; and a coupling structure coupling the outside surface attachment subassembly to the clamp attachment assembly in operable engagement; and a mating engagement member positioned proximate each of the plurality of magnets and corresponding magnets and ferromagnetic members of the clamp assembly members and a corresponding mating engagement member is disposed on the clamp attachment subassembly proximate the one of the magnet and the ferromagnetic member of the clamp attachment subassembly, whereupon engagement of the clamp attachment subassembly and the clamp assembly, the mating engagement member of the clamp assembly and the mating engagement member of the clamp attachment subassembly positively engage to limit slidable movement, and, in turn, disengagement of the clamp assembly and the clamp attachment subassembly.

2. The display attachment apparatus of claim 1 wherein the mating engagement member of one of the clamp assembly and the clamp attachment subassembly comprises a post and the mating engagement member of the other of the clamp assembly and the clamp attachment subassembly comprises a slot.

3. The display attachment apparatus of claim 2 wherein the slot comprises an arcuate slot centered about the corresponding magnet or ferromagnetic member which allows for at least partial rotation of the clamp attachment subassembly about the corresponding magnet or ferromagnetic member.

4. The display attachment apparatus of claim 1 wherein the outside surface attachment subassembly further comprises one of a magnet and a c-channel clamp.

5. A display attachment apparatus comprising:

a clamp assembly having a first clamp arm, a second clamp arm and a hinge assembly hingedly coupling the first clamp arm to the second clamp arm, the first clamp arm having a plurality of magnets and the second clamp arm having a plurality of at least one of magnets and ferromagnetic members, the plurality of magnets on the first clamp corresponding to the plurality of at least one of magnets and ferromagnetic members so as to be attracted to each other when the clamp assembly is in an engaging configuration; and a mounting assembly having an outside surface attachment subassembly structurally configured to engage an outside surface;

a clamp attachment subassembly which includes one of a magnet and a ferromagnetic member releasably engageable with at least one of the corresponding magnets and ferromagnetic members of one of the first and second clamp arms; and a coupling structure coupling the outside surface attachment subassembly to the clamp attachment assembly in operable engagement, wherein the coupling structure comprises a cavity having an opening and an access slot positioned on one of the clamp attachment subassembly and the outside surface attachment subassembly, and a tab extending from a neck on the other of the clamp attachment subassembly and the outside surface attachment assembly, wherein the tab can be inserted in the cavity through the access slot so that the neck extends through the opening, while the tab is larger than the opening, and precluded from passage therethrough, while allowing the tab to rotate while positioned within the cavity.

6. The display attachment apparatus of claim 1 wherein the plurality of magnets of the first clamp arm comprise three spaced apart magnets and the plurality of one of magnets and ferromagnetic members of the second clamp arm comprise three spaced apart magnets each of the magnets on the first and second clamp arms is positioned within a magnet housing that extends inwardly on each clamp arm, each clamp arm having an inward projection terminating at the hinge, such that upon engagement of the magnets of the first and second clamp arms, with a display item positioned therebetween, the clamp arms are substantially parallel to each other and have a substantially uniform distance therebetween.

7. The display attachment apparatus of claim 1 wherein each of the first clamp arm and the second clamp arm further include an outward flange that extends orthogonal from a bottom end of each clamp arm.

8. The display attachment apparatus of claim 1 wherein the hinge assembly comprises a plurality of discrete live hinge members joining the first clamp arm and the second clamp arm.

9. The display attachment apparatus of claim 1 further comprising an installation tool, comprising:

a body having a central coupling region and opposing clamp arm engagement structures, the clamp engagement structures each having a pair of fingers which are configured to engage a portion of a bottom end of one of the first clamp arm and the second clamp arm therebetween; and an upper end engagement member configured to extend over and beyond the top end of the first and second clamp arms so as to positively engage and maintain the bottom end of the one of the first clamp arm and second clamp arm to which it is attached.

10. The display attachment apparatus of claim 9 wherein the installation tool further comprises a pole extending from the central coupling region.

11. The display attachment apparatus of claim 1 wherein the plurality of magnets and ferromagnetic members are integrally molded with at least one of the clamp arms.

12. A display attachment apparatus comprising:

a clamp assembly having a first clamp arm, a second clamp arm and a hinge assembly hingedly coupling the first clamp arm to the second clamp arm, the first clamp arm having a plurality of magnets and the second clamp arm having a plurality of at least one of magnets and ferromagnetic members, the plurality of magnets on the first clamp corresponding to the plurality of at least one of magnets and ferromagnetic members so as to be attracted to each other when the clamp assembly is in an engaging configuration; and a mounting assembly having an outside surface attachment subassembly structurally configured to engage an outside surface;

a clamp attachment subassembly which includes one of a magnet and a ferromagnetic member releasably engageable with at least one of the corresponding magnets and ferromagnetic members of one of the first and second clamp arms; and a coupling structure coupling the outside surface attachment subassembly to the clamp attachment assembly in operable engagement, wherein, the clamp attachment subassembly further comprises a first side and a second side, a magnet extending from the first side to the second side and a mating engagement member extending outwardly from each of the first and second sides proximate the magnet.

* * * * *